United States Patent [19]

Fröhling et al.

[11] 4,350,310

[45] Sep. 21, 1982

[54] APPARATUS FOR BRAKING TRAVELLING STRIP MATERIAL

[76] Inventors: Peter Fröhling, An den Klippen 9; Franz F. Schulz, Krähenwinkel 6, both of D-5960 Olpe, Biggesee; Karl Wiedemer, Hubertusweg 19, D-5900 Siegen, all of Fed. Rep. of Germany

[21] Appl. No.: 214,731

[22] Filed: Dec. 9, 1980

[30] Foreign Application Priority Data

Dec. 12, 1979 [DE] Fed. Rep. of Germany ..... 2949902

[51] Int. Cl.[3] ..... B65H 23/10; B65H 23/18

[52] U.S. Cl. ..... 242/75.2; 226/39

[58] Field of Search ..... 242/75, 75.2, 74, 67.1 R; 226/38, 39, 95, 97

[56] References Cited

U.S. PATENT DOCUMENTS

| | | | |
|---|---|---|---|
| 2,967,674 | 1/1961 | Lawrence | 242/75.2 |
| 2,994,489 | 8/1961 | Hare | 242/75.2 |
| 3,799,419 | 3/1974 | Herzhoff | 226/39 |

FOREIGN PATENT DOCUMENTS

| | | | |
|---|---|---|---|
| 84308 | 9/1933 | Sweden | 242/75.2 |
| 165510 | 3/1934 | Switzerland | 242/75.2 |

*Primary Examiner*—Edward J. McCarthy
*Attorney, Agent, or Firm*—Fleit & Jacobson

[57] ABSTRACT

To apply a braking force to only one face of travelling strip material with the least possible surface scratching, it is passed over an evacuated box having a perforated wall covered by a permeable layer.

3 Claims, 5 Drawing Figures

Pu 2
1
6
4
-9-
-9-
-9-
-9-
6
V̇
Pu
V̇
Pu
6
3
5
5
6
V̇
Pu

APPARATUS FOR BRAKING TRAVELLING STRIP MATERIAL

The invention relates to an apparatus for braking travelling elongate strip material, particularly of non-ferrous metals, prior to winding the material into a coil.

When coiling travelling strip material, the strip to be wound has to be placed under moderate tensile stress. This tensile stress is absolutely essential for winding if the finished coil is to be sufficiently taut for subsequent transport without damage and subsequent processing.

It is therefore usual to provide apparatuses for braking the strips upstream of the coilers. For this purpose, the strip is for example passed between two rollers which are biased towards each other. The rotary motion of these rollers is braked to produce the desired strip tension. In other arrangements, the strip is pulled directly between two pressurised braking jaws and is therefore braked under friction.

In these known arrangements, the top surface as well as the underside of the strip must be in contact with the components of the brake for the purpose of exerting the braking effect. However, smooth metallic surfaces such as those produced during cold rolling are highly sensitive and immediately exhibit traces of contact when brought into contact with the braking apparatuses. This constitutes a considerable disadvantage of hitherto known strip braking apparatuses.

A strip brake is also known which touches only one side of the strip and wherein a magnetic strip material such as iron or steel is pulled over the surface of an electromagnet and thereby braked. Such a strip brake will deliver a coiled strip having one surface of good quality without any scratch markings but the utility of this brake is very limited. Especially for non-ferrous metals such as aluminum, which are much softer than ferrous metals, but also for plastics materials where scratch markings are particularly evident, this strip brake is useless because of the non-magnetic properties of the stated materials.

The invention therefore aims to provide a one-sidedly effective apparatus for braking travelling elongate strip material prior to coiling, the apparatus to be quite universally applicable, i.e. also for strips of non-magnetic material such as plastics and in particular non-ferrous metal.

The subject of the invention is therefore an apparatus for braking travelling strip material on one side before the material is wound into a coil. The apparatus of the invention is characterized by a box of which the interior is under vacuum, one wall of the box being perforated and covered with an air-permeable covering over which the strip to be braked slides.

FIG. 1 of the accompanying drawings is a side elevation of the apparatus according to the invention taken in section along the line I—I in FIG. 2;

Equivalent components are designated by the same reference numerals in all the figures.

Figure 1:
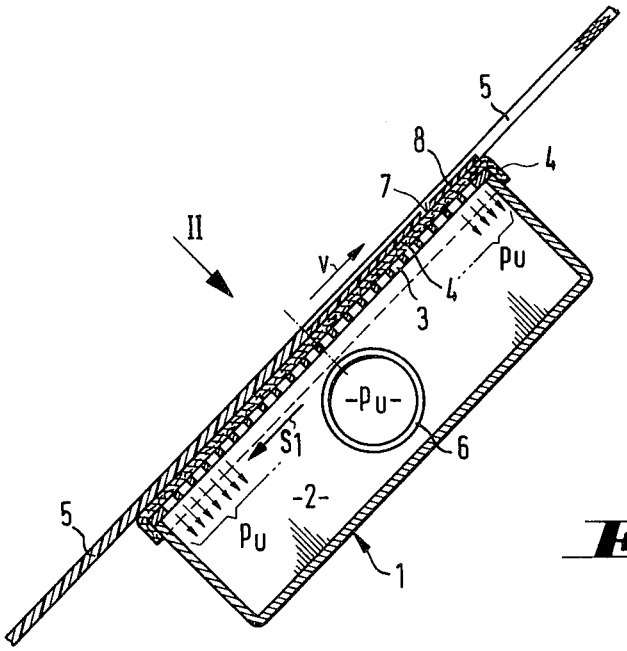

The strip 5 to be braked is pulled over the air box 1 (see FIG. 1). The strip thereby glides over an air-permeable covering 4 (for example of textile fabric, fleece etc) which, in turn, lies on a perforated wall 3 of the air box. By means of a connecting nipple 6, the air box is connected to a suction fan (not shown) and is continuously subjected to a vacuum $P_u$ by evacuating the air. The vacuum brings about a constant flow through the air-permeable covering. The air thus entering the air box must be withdrawn by the suction fan as a volumetric stream $\dot{V}$.

The surface areas not covered by the strips to be braked are excluded from a penetrating flow. Vacuum is thereby produced directly beneath the strips by means of the suction fan. The exterior air pressure now pushes the strip onto the air-permeable covering and thereby produces the desired frictional force $S_1$ on the strip which is pulled in the direction v. This produces the desired strip tension by means of contact with only one side of the strip.

By changing the sub-atmospheric pressure, one can alter the strip tension and thereby easily suit the requirements of the coiling machine.

Figure 2:
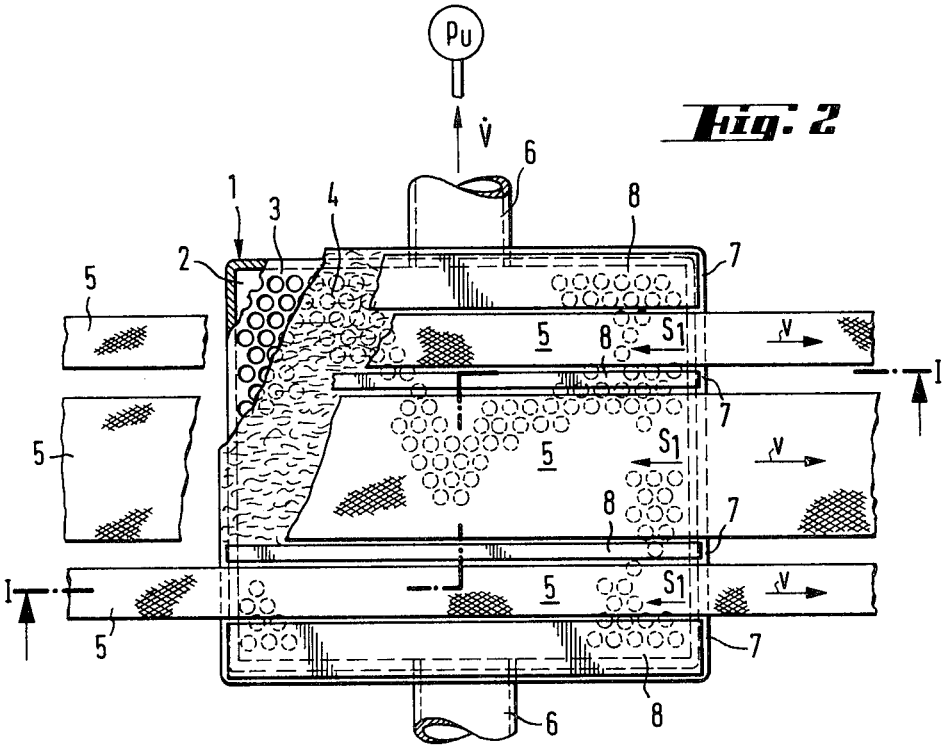
FIG. 2 is a plan view of the FIG. 1 apparatus in the direction of the arrow II in FIG. 1.
Figure 4:
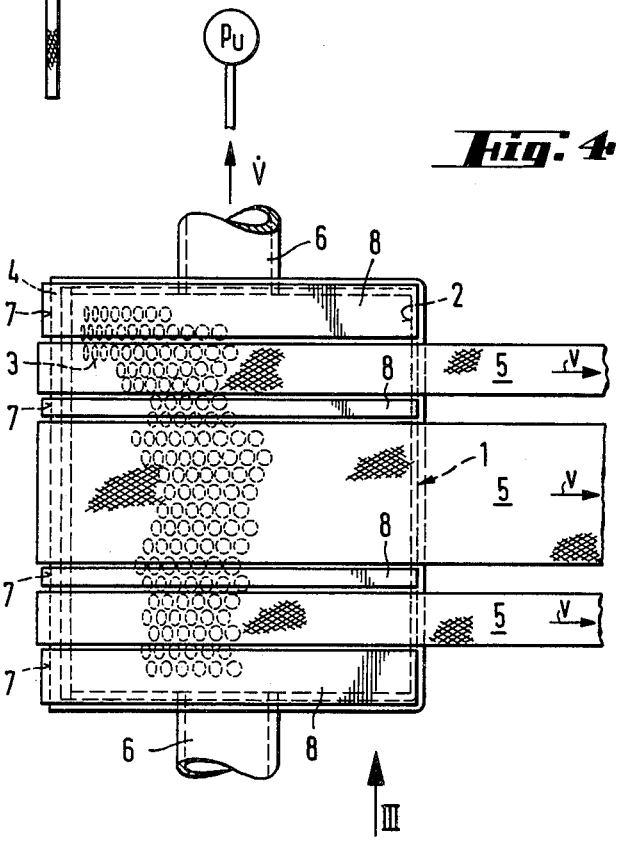
FIG. 4 is a plan view of the FIG. 3 apparatus in the direction of the arrow IV of FIG. 3.

The apparatus of the invention is preferably also constructed for simultaneously braking a plurality of parallel travelling strips 5 which are subsequently to be wound in juxtaposition on the common shaft of a coiler. Thus, FIGS. 2 and 4 show three such simultaneously braked parallel travelling strips 5.

To keep the volumetric stream of air $\dot{V}$ as small as possible and thereby also minimise the capacity of the fan, it is desirable to close off those areas 7 (FIGS. 2 and 4) which are not covered by the strips 5, for example by covering these areas with an impermeable foil 8.

Figure 5:
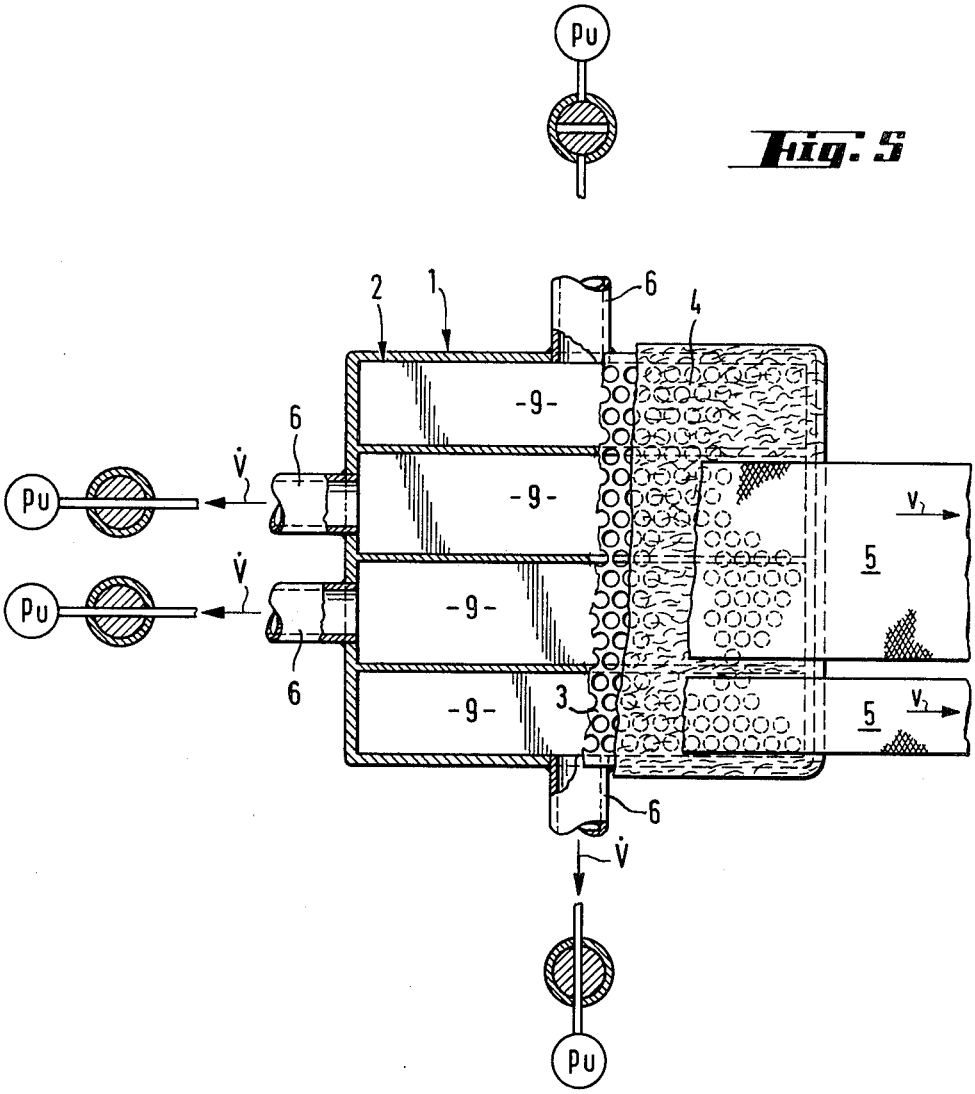
FIG. 5 is a part-sectional plan view of a further embodiment of the apparatus according to the invention.

However, the same effect can also be achieved by sub-dividing the air box into chambers 9 longitudinally of the strip direction and connecting these in zones (FIG. 5). In this case, only those chambers are connected to the fan which are disposed in the vicinity of the strips to be braked.

Figure 3:
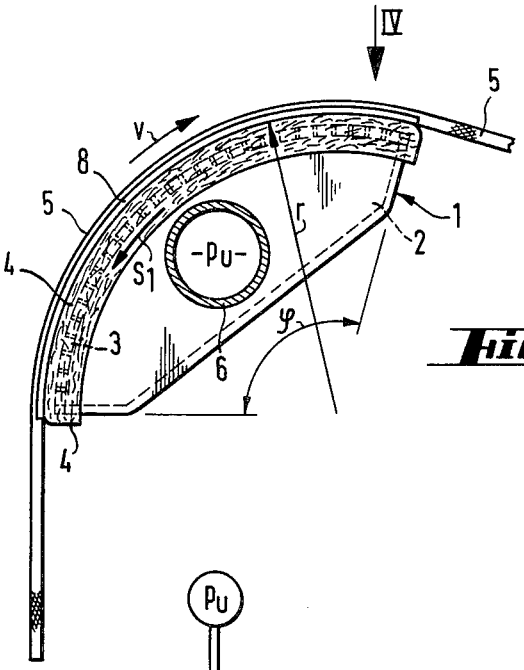
FIG. 3 is a sectional side elevation of a preferred embodiment of the apparatus of the invention viewed in the direction of the arrow III in FIG. 4.

The perforated wall 3 of the box 1 is preferably curved and the air-permeable covering 4 lies against this curved wall 3 (see FIG. 3). In this way it is possible to change the direction of travel of the strip or strips during braking.

The braking force to be produced per millimeter of strip width depends on the sub-atmospheric pressure $p_u$ in the interior 2 of the box 1, the radius of curvature r, the angle $\phi$ of circumferential contact with the strip and the coefficient of friction between the strip and the air-permeable covering (see FIG. 3).

As will be evident from the foregoing description, the strip brake according to the invention is applicable not only to strips of ferrous magnetisable material but also quite universally to strips such as aluminium, copper and other non-ferrous metals or alloys, even to strips of plastics material and generally to non-ferrous metals. This versatile utility offers a very considerable technical advance by means of the strip brake according to the invention.

We claim:

1. A device for the simultaneous braking of a plurality of parallel running strips comprising:

a box connectable to a source of negative pressure, the box having side and bottom walls cooperating with each to define an enclosed space and a perforated upper surface forming a slide base;

an air-permeable covering positioned on top of said slide base and contacting lower surfaces of the strips so that the lower surfaces of the strips are suction attracted towards and into sliding contact with the air-permeable covering; and an air-impermeable covering positioned on said air-permeable covering to cover portions of the air-permeable covering not contacting said strips.

2. Device in accordance with claim 1, characterized by the fact that the air-impermeable covering is a foil.

3. Device in accordance with one of claims 1 or 2, wherein the slide base has a curved surface.

* * * * *